US012102125B2

(12) United States Patent
Conley et al.

(10) Patent No.: US 12,102,125 B2
(45) Date of Patent: Oct. 1, 2024

(54) VAPING VAPORIZER

(71) Applicant: FUMA INTERNATIONAL, LLC, Medina, OH (US)

(72) Inventors: Gregory D. Conley, Medina, OH (US); Daniel C. Hillenbrandt, Jr., Medina, OH (US)

( * ) Notice: Subject to any disclaimer, the term of this patent is extended or adjusted under 35 U.S.C. 154(b) by 99 days.

(21) Appl. No.: 16/196,465

(22) Filed: Nov. 20, 2018

(65) Prior Publication Data

US 2019/0150510 A1 May 23, 2019

Related U.S. Application Data

(60) Provisional application No. 62/707,901, filed on Nov. 21, 2017.

(51) Int. Cl.

| | |
|---|---|
| ***A24F 40/46*** | (2020.01) |
| ***A24D 3/17*** | (2020.01) |
| ***A24F 40/42*** | (2020.01) |
| ***A24F 40/485*** | (2020.01) |

(52) U.S. Cl.
CPC ..... *A24F 40/46* (2020.01); *A24D 3/17* (2020.01); *A24F 40/42* (2020.01); *A24F 40/485* (2020.01)

(58) Field of Classification Search
CPC ..... A24D 3/17; A24F 47/008
See application file for complete search history.

(56) References Cited

U.S. PATENT DOCUMENTS

| | | | |
|---|---|---|---|
| 2,057,353 | A | 9/1935 | Whittemore, Jr. |
| 3,200,819 | A | 8/1965 | Gilbert |
| 4,284,089 | A | 8/1981 | Ray |
| 4,945,929 | A | 8/1990 | Egilmex |
| 4,947,874 | A | 8/1990 | Brooks |
| 4,966,171 | A | 10/1990 | Serrano et al. |
| 4,969,476 | A | 11/1990 | Bale et al. |
| 5,050,621 | A | 9/1991 | Creighton et al. |
| 5,115,820 | A | 5/1992 | Hauser et al. |
| 5,249,586 | A | 10/1993 | Morgan et al. |
| 5,865,185 | A | 2/1999 | Collins et al. |
| 5,878,752 | A | 3/1999 | Adams et al. |

(Continued)

FOREIGN PATENT DOCUMENTS

| | | |
|---|---|---|
| CN | 200966824 | 10/2007 |
| CN | 201018927 | 2/2008 |

(Continued)

OTHER PUBLICATIONS

Wikipedia; Electronic cigarette—Wikipedia, the free encyclopedia; Feb. 9, 2010; http://web.archive.org/web/20100209122659/http://en.wikipedia.org/wiki/Electronic_cigarette.

(Continued)

*Primary Examiner* — Michael H. Wilson
*Assistant Examiner* — Stephanie Lynn Moore

(57) ABSTRACT

A vaporizer for use with a vaping device is provided. A vaporizer includes a tank base portion, an enclosure portion supported by the base portion, and a heating cup contained within the tank base portion and the enclosure portion. The heating cup including a first portion received in an interior cavity of the tank base portion, and a second portion received in an interior of the enclosure portion. The heating cup being configured to receive and facilitate vaporization of a vaping medium received therein.

16 Claims, 12 Drawing Sheets

(56) References Cited

U.S. PATENT DOCUMENTS

| | | | |
|---|---|---|---|
| 6,196,218 | B1 | 3/2001 | Voges |
| 6,443,146 | B1 | 9/2002 | Voges |
| 7,412,259 | B2 | 8/2008 | Yoo et al. |
| D590,988 | S | 4/2009 | Hon |
| D590,989 | S | 4/2009 | Hon |
| D590,990 | S | 4/2009 | Hon |
| D590,991 | S | 4/2009 | Hon |
| 7,581,540 | B2 | 9/2009 | Hale et al. |
| D613,903 | S | 4/2010 | Wu |
| D613,904 | S | 4/2010 | Wu |
| 7,726,320 | B2 | 6/2010 | Robinson et al. |
| 7,832,410 | B2 | 11/2010 | Hon |
| 7,832,655 | B2 | 11/2010 | Tollens et al. |
| 7,984,684 | B2 | 7/2011 | Hinderks |
| 8,156,944 | B2 | 4/2012 | Han |
| 8,603,397 | B2 | 12/2013 | Gruenbacher et al. |
| 8,689,805 | B2 | 4/2014 | Hon |
| 8,794,231 | B2 | 8/2014 | Thorens et al. |
| 8,863,753 | B2 | 10/2014 | Li et al. |
| 8,897,628 | B2 | 11/2014 | Conley et al. |
| 8,961,492 | B2 | 2/2015 | Imran et al. |
| 8,997,753 | B2 | 4/2015 | Li et al. |
| 8,997,754 | B2 | 4/2015 | Tucker et al. |
| 9,004,073 | B2 | 4/2015 | Tucker et al. |
| 9,095,175 | B2 | 8/2015 | Terry et al. |
| 9,148,009 | B2 | 9/2015 | Xiang |
| 9,197,726 | B2 | 11/2015 | Stanimirovic et al. |
| 9,204,670 | B2 | 12/2015 | Liu |
| D749,505 | S | 2/2016 | Verleur et al. |
| D750,320 | S | 2/2016 | Verleur et al. |
| 9,259,035 | B2 | 2/2016 | Terry et al. |
| D752,278 | S | 3/2016 | Verleur et al. |
| D752,280 | S | 3/2016 | Verleur et al. |
| D752,727 | S | 3/2016 | Tracey |
| 9,301,548 | B2 | 4/2016 | Liu |
| 9,301,549 | B2 | 4/2016 | Liu |
| 9,332,787 | B2 | 5/2016 | Liu |
| 9,352,288 | B2 | 5/2016 | Terry et al. |
| 9,364,024 | B2 | 6/2016 | Liu |
| 9,364,025 | B2 | 6/2016 | Liu |
| D763,502 | S | 8/2016 | Verleur et al. |
| 9,417,107 | B2 | 8/2016 | Xiang |
| 9,427,711 | B2 | 8/2016 | Terry et al. |
| D767,820 | S | 9/2016 | Jordan et al. |
| D767,822 | S | 9/2016 | Jordan et al. |
| 9,486,014 | B2 | 11/2016 | Liu |
| D776,869 | S | 1/2017 | Heidl |
| 9,532,597 | B2 | 1/2017 | Tucker et al. |
| 9,532,604 | B2 | 1/2017 | Conley et al. |
| 9,555,203 | B2 | 1/2017 | Terry et al. |
| D779,725 | S | 2/2017 | Bramley et al. |
| D780,993 | S | 3/2017 | Bramley et al. |
| D782,108 | S | 3/2017 | Jordan et al. |
| 9,597,466 | B2 | 3/2017 | Henry, Jr. et al. |
| 9,602,646 | B2 | 3/2017 | Stanimirovic et al. |
| 9,609,893 | B2 | 4/2017 | Novak, III et al. |
| 2005/0016550 | A1 | 1/2005 | Katase |
| 2006/0196518 | A1 | 9/2006 | Hon |
| 2007/0267031 | A1 | 11/2007 | Hon |
| 2008/0073443 | A1 | 3/2008 | Tollens et al. |
| 2008/0092912 | A1 | 4/2008 | Robinson et al. |
| 2008/0230052 | A1 | 9/2008 | Montaser |
| 2008/0247892 | A1 | 10/2008 | Kawasumi |
| 2008/0257367 | A1 | 10/2008 | Paterno et al. |
| 2008/0276947 | A1 | 11/2008 | Martzel |
| 2008/0303286 | A1 | 12/2008 | Vangel |
| 2009/0095311 | A1 | 4/2009 | Han |
| 2009/0126745 | A1 | 5/2009 | Hon |
| 2009/0272379 | A1 | 11/2009 | Thorens et al. |
| 2010/0031968 | A1 | 2/2010 | Sheikh et al. |
| 2010/0037903 | A1 | 2/2010 | Coleman, III et al. |
| 2010/0200006 | A1 | 8/2010 | Robinson et al. |
| 2010/0200008 | A1 | 8/2010 | Taieb |
| 2010/0242974 | A1 | 9/2010 | Pan |
| 2011/0011396 | A1 | 1/2011 | Fang |
| 2011/0192399 | A1 | 8/2011 | Wilke et al. |
| 2011/0277757 | A1 | 11/2011 | Terry et al. |
| 2011/0277760 | A1 | 11/2011 | Terry et al. |
| 2011/0304282 | A1 | 12/2011 | Li et al. |
| 2012/0285475 | A1 | 11/2012 | Liu |
| 2013/0309102 | A1 | 11/2013 | Gruenbacher et al. |
| 2013/0312739 | A1 | 11/2013 | Rome et al. |
| 2014/0020696 | A1 | 1/2014 | Liu |
| 2014/0060528 | A1 | 3/2014 | Liu |
| 2014/0069444 | A1 | 3/2014 | Cyphert et al. |
| 2014/0096781 | A1 | 4/2014 | Sears et al. |
| 2014/0096782 | A1 | 4/2014 | Ampolini et al. |
| 2014/0150783 | A1 | 6/2014 | Liu |
| 2014/0150784 | A1 | 6/2014 | Liu |
| 2014/0190478 | A1 | 7/2014 | Liu |
| 2014/0190502 | A1 | 7/2014 | Liu |
| 2014/0253144 | A1 | 9/2014 | Novak, III et al. |
| 2014/0261495 | A1 | 9/2014 | Novak, III et al. |
| 2014/0305450 | A1 | 10/2014 | Xiang |
| 2015/0065929 | A1 | 3/2015 | Walker |
| 2015/0078735 | A1 | 3/2015 | Cormack |
| 2015/0090281 | A1 | 4/2015 | Chen |
| 2015/0128966 | A1 | 5/2015 | Lord |
| 2015/0189916 | A1 | 7/2015 | Wu |
| 2015/0215439 | A1 | 7/2015 | Stanimirovic et al. |
| 2015/0258289 | A1 | 9/2015 | Henry, Jr. et al. |
| 2015/0296885 | A1 | 10/2015 | Liu |
| 2016/0235124 | A1* | 8/2016 | Krietzman ..... A24B 15/16 |
| 2016/0374392 | A1 | 12/2016 | Liu |
| 2017/0086506 | A1* | 3/2017 | Rado ..... H05B 1/0227 |

FOREIGN PATENT DOCUMENTS

| | | |
|---|---|---|
| CN | 201085044 | 7/2008 |
| CN | 201238610 | 5/2009 |
| CN | 201379072 | 1/2010 |
| KR | 20090033311 | 4/2009 |
| WO | WO2000/028843 | 5/2000 |
| WO | WO2005099494 | 10/2005 |
| WO | WO2007/078273 | 7/2007 |
| WO | WO2007/131449 | 11/2007 |
| WO | WO2007131450 | 11/2007 |
| WO | WO2010/091593 | 8/2010 |

OTHER PUBLICATIONS

Crown 7 Hydro device; https://www.youtube.com/watch?v=tQNFFw8A_DI (YouTube video published on Dec. 10, 2008).
NJOY NPRO device; https://www.youtube.com/watch?v=TBdX24ALPLY (YouTube video published on Dec. 5, 2008).

* cited by examiner

VAPING VAPORIZER

The present application claims benefit of U.S. Provisional Application No. 62/707,901, filed Nov. 21, 2017; all of which is incorporated by reference herein.

FIELD

The present technology is generally related to a vaping vaporizer capable of facilitating vaping of a vaping medium that can include solids, waxes, and liquids.

BACKGROUND

Vaping devices can employ vaporizers to facilitate vaping of vaping mediums, and the vaping mediums can typically include solids, waxes, and liquids. Preferred vaping requires that the vaping medium be vaporized not combusted, because combustion of the vaping medium may create unwanted byproducts. Typical vaporizers facilitate vaporization of the vaping medium such as solids and waxes via conduction. That is, the solids and waxes are heated via direct contact with heating componentry to facilitate vaporization. However, such conduction via direct contact with the solids and waxes can cause some or all of these vaping mediums to combust rather than vaporize. Therefore, there is a need for a vaporizer that facilitates more complete vaporization of solids and waxes. Such a vaporizer can employ preheated air that vaporizes these vaping mediums via convection when applied thereto.

DETAILED DESCRIPTION OF THE PREFERRED EMBODIMENT

Figure 1:
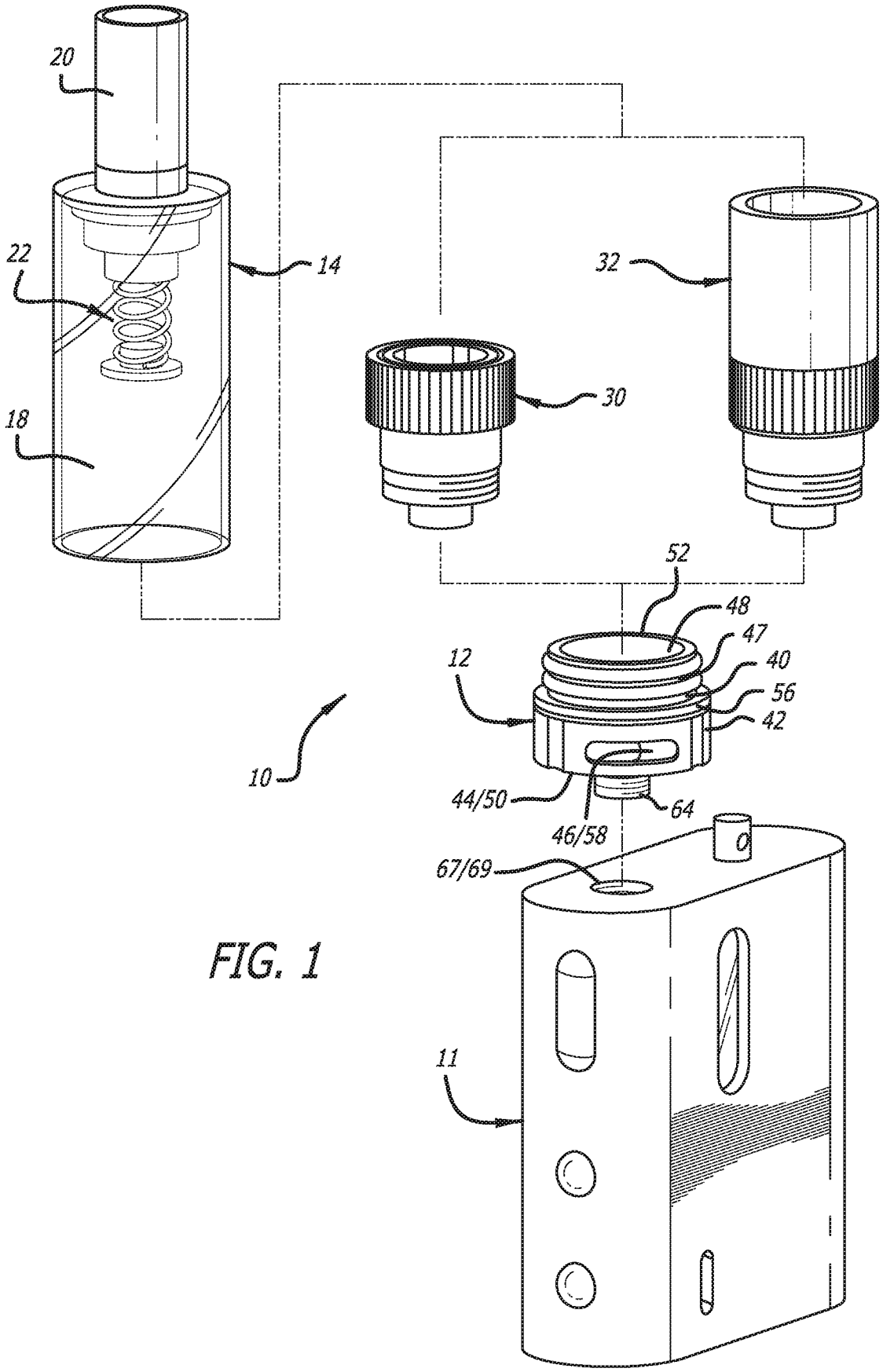
FIG. 1 is a perspective side exploded view that illustrates a vaporizer and a power source according to an embodiment of the present disclosure.
Figure 2:
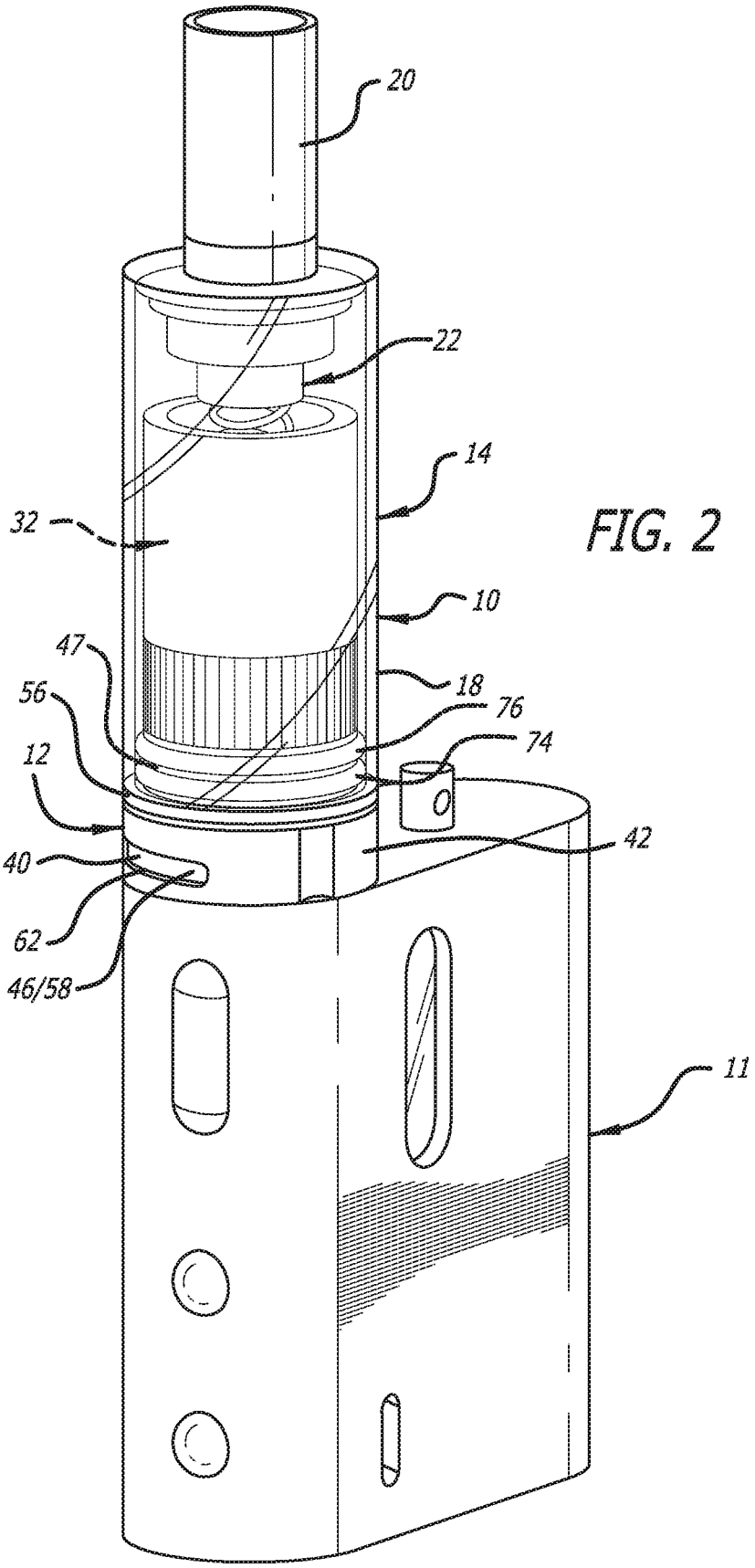
FIG. 2 is a perspective side view that illustrates the vaporizer and the power source of FIG. 1 assembled to one another.

A vaping vaporizer used for vaping and incorporating features according to a preferred embodiment of the present disclosure is generally referenced by the numeral 10 in FIGS. 1-3, 6, and 7. As discussed below, the vaporizer 10, as depicted in FIGS. 1 and 2, can be configured for attachment to a portable power source 11 to supply electrical power used to facilitate heating and/or burning of a vaping medium (not shown) by the vaporizer 10. The vaporizer 10 serves as a tank for containing and vaporizing the vaping medium. As such, a user can use the vaporizer 10 to vape the vaping medium provided in the vaporizer 10, and the vaping medium can include solids, waxes, and liquids.

As depicted in FIGS. 1-3, 6, and 7, the vaporizer 10 can include a tank base portion 12, and an enclosure portion 14. As discussed below, the enclosure portion 14 includes a wall portion 18, an inhaler portion 20, and a containment mechanism 22. Furthermore, as depicted in FIG. 1, the base portion 12 and the enclosure portion 14 can include either a first heating cup 30 or a second heating cup 32 disposed therein. The first heating cup 30 and the second heating cup 32 are configured to be interchangeably received in portions of the tank base portion 12 and the enclosure portion 14. As discussed below, the first heating cup 30 and the second heating cup 32 are releasably attachable to the tank base portion 12, and the enclosure portion 14 is receivable over portions of the tank base portion 12 and either of the first heating cup 30 and the second heating cup 32.

The vaping medium can be inserted into portions of the first heating cup 30 and the second heating cup 32, and the first heating cup 30 and the second heating cup 32 can be used for vaporizing the vaping medium.

Figure 4:
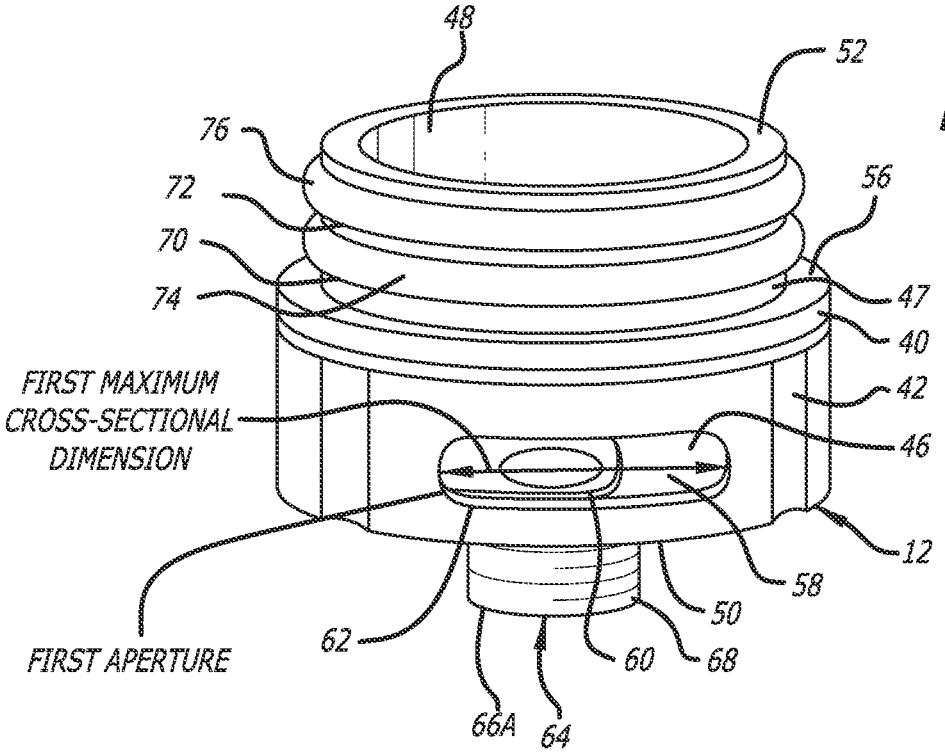
FIG. 4 is an enlarged side perspective view that illustrates a base portion of the vaporizer of FIG. 1.
Figure 5:
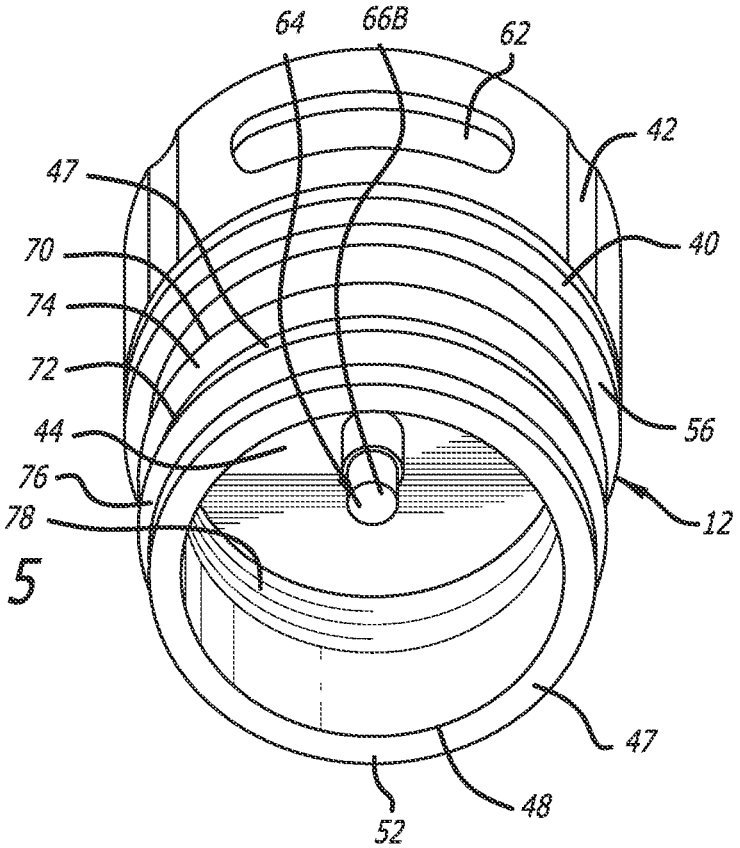
FIG. 5 is an enlarged top perspective view that illustrates the base portion of the vaporizer of FIG. 1.
Figure 6:
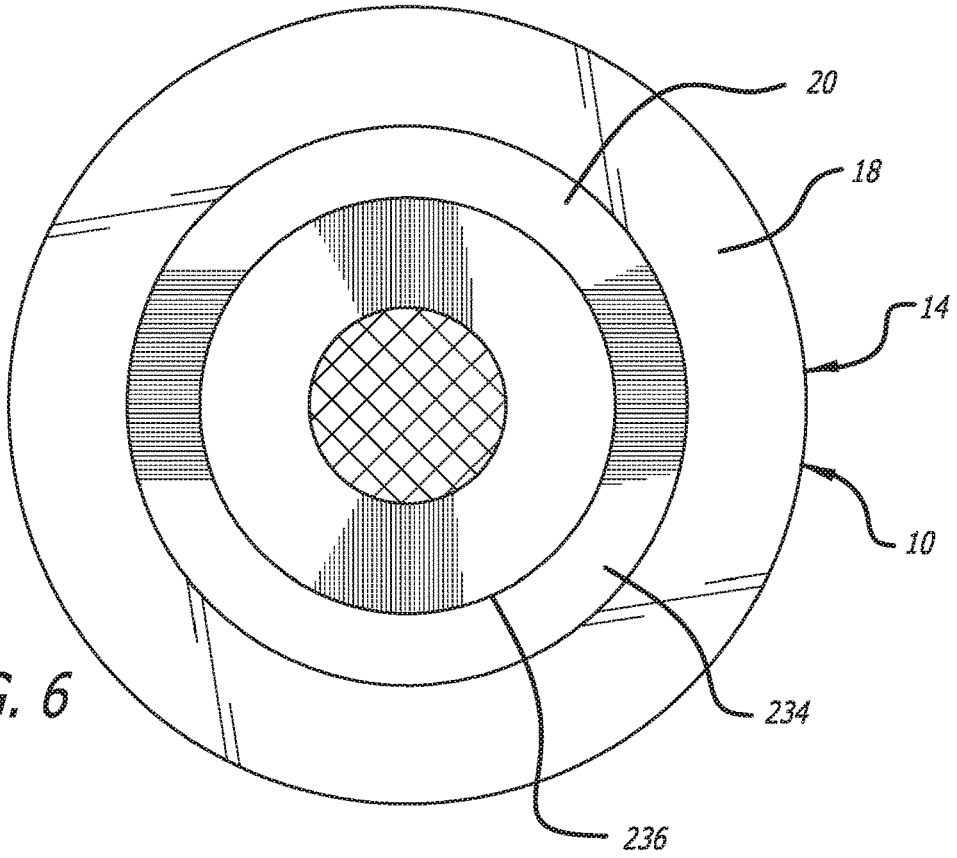
FIG. 6 is an enlarged top plan view that illustrates the vaporizer of FIG. 1.
Figure 7:
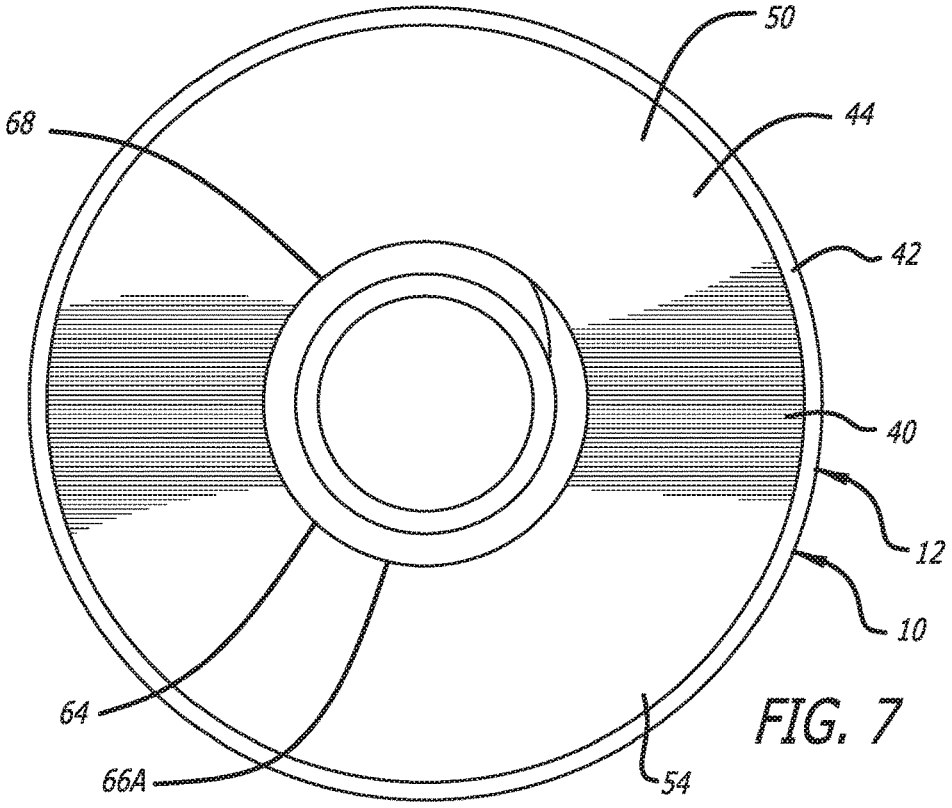
FIG. 7 is an enlarged bottom plan view that illustrates the vaporizer of FIG. 1.

As depicted in FIGS. 4 and 5, the tank base portion 12 includes a first portion 40 and a second portion 42. The first portion 40 serves as a carriage for carrying the second portion 42, and the first portion 40 and the second portion 42 are rotatable with respect to one another between a first position and a second position. To illustrate, the first portion 40 and the second portion 42 are approximately halfway between the first position and the second position in FIG. 4.

The first portion 40, as depicted in FIGS. 4 and 5, includes a bottom wall portion 44, a first side wall portion 46, a second sidewall portion 47, an interior cavity 48, a closed first end 50, and an open second end 52. The first sidewall portion 46 and the second sidewall portion 47 can have cylindrical exterior surfaces. Furthermore, the bottom wall portion 44 is collocated with the closed first end 50, the first sidewall portion 46 extends from the bottom wall portion 44 to the second sidewall portion 47, and the second sidewall portion 47 extends from the first sidewall portion 46 to the open second end 52. The open second end 52 provides access to the interior cavity 48, and the interior cavity 48 extends through at least portions of the first sidewall portion 46 and the second sidewall portion 47.

The first sidewall portion 46 includes a first flange portion 54 (FIG. 7) and a second flange portion 56 (FIGS. 4 and 5), and the first flange portion 54, the second flange portion 56, and an exterior surface 58 (FIG. 4) of the first sidewall portion 46 serve as a collar for receiving the second portion 42 of the tank base portion 12. The second portion 42 can be positioned between the first flange portion 54 and the second flange portion 56, and the second portion 42 acts as a sleeve covering the exterior surface 58.

The first sidewall portion 46 can include apertures 60 therethrough that extend through the exterior surface 58 into the interior cavity 48. Furthermore, the second portion 42 includes apertures 62 therethrough. One of the apertures 60 is depicted in FIG. 4, and another can be positioned opposite from the one of the apertures 60 depicted in FIG. 4. Furthermore, one of the apertures 62 is depicted in FIG. 4, and another of the apertures 62 is depicted in FIG. 5. The apertures 60 and 62 have similar dimensions, and rotation of the second portion 42 relative to the first sidewall portion 46 can bring a set of the apertures 60 and 62 into or out of alignment thereof. For example, one of the apertures 60 can be completely uncovered by the respective one of the apertures 62 in the first position of the second portion 42 relative to the first sidewall portion 46, one of the apertures 60 can be completely covered by the respective one of the apertures 62 in the second position of the second portion 42 relative to the first sidewall portion 46 (as depicted in FIG. 5), and one of the apertures 60 can have gradations of being covered/uncovered by the respective one of the apertures 62 between the first position and the second position (as depicted in FIG. 4). The covering and uncovering of the apertures 60 can be used to alter to volume of air that can be drawn therethrough into the interior cavity 48. As discussed below, the air drawn into the interior cavity 48 ultimately exits the vaping vaporizer 10 through the inhaler portion 20. When either of the first heating cup 30 or the second heating cup 32 are received in the interior cavity 48, the interior cavity 48 serves as a first stage air heating chamber for heating air drawn through the vaporizer 10.

Figure 3:
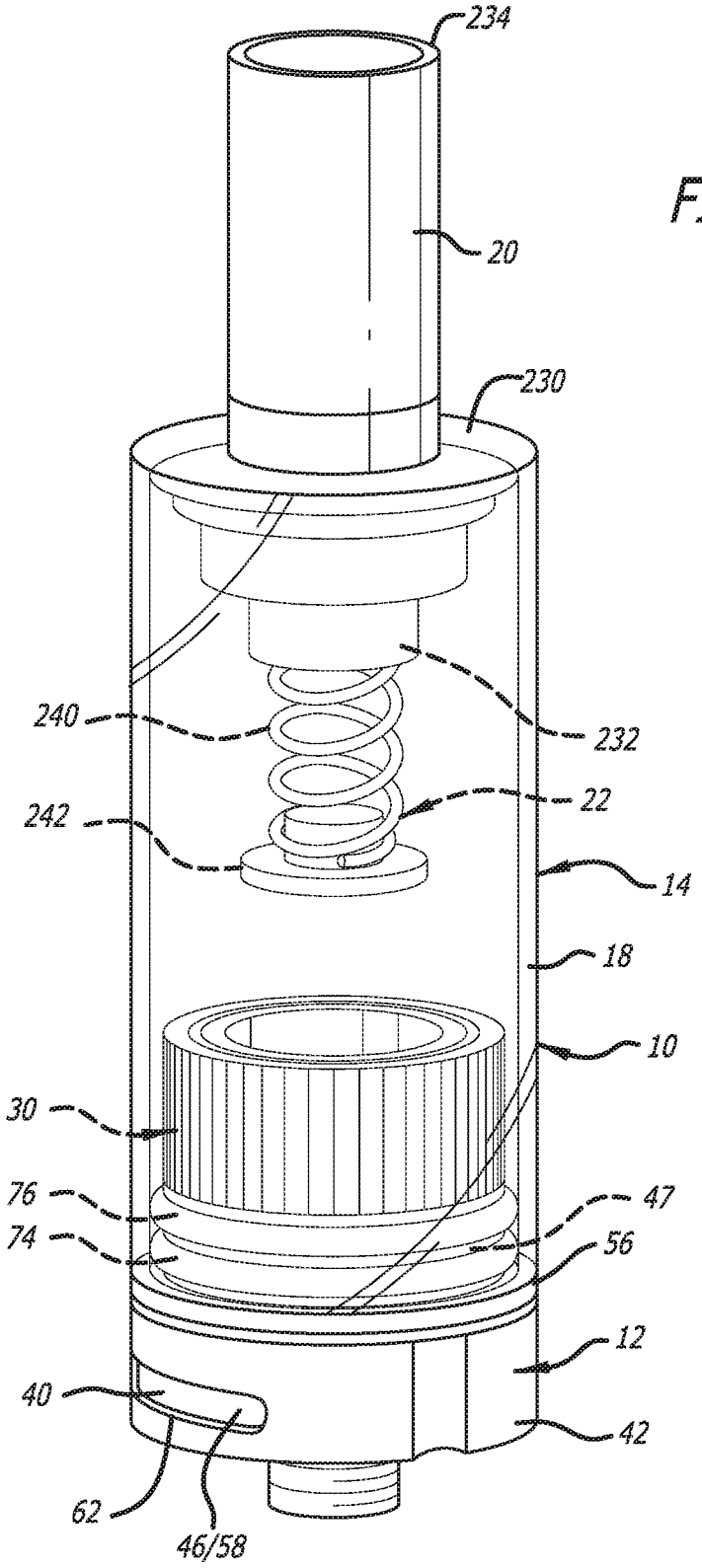
FIG. 3 is an enlarged side perspective view that illustrates the vaporizer of FIG. 1.

As depicted in FIGS. 4 and 5, the second sidewall portion 47 can include recesses 70 and 72 for receiving seals 74 and 76, respectively. The wall portion 18 of the enclosure portion 14, as depicted in FIGS. 2 and 3, can be received over the second sidewall portion 47, and in doing so, the wall portion 18 can be sealed against the second sidewall portion 47 using the seals 74 and 76. The seal between the wall portion 18 and the second sidewall portion 47 can be fluid tight, and facilitate releasable attachment of the enclosure portion 14 to the tank base portion 12. The enclosure portion 14 can be detached and reattached to the tank base portion 12 to provide access to the tank base portion 12 and one of the first heating cup 30 and the second heating cup 32 attached to the tank base portion 12.

The bottom wall portion 44 includes at the closed first end 50 a conductive element 64 extending therethrough that includes, as depicted in FIGS. 4 and 5, an exterior portion 66A and an interior portion 66B. Furthermore, as depicted in FIG. 1, the power surface 11 includes an aperture 67 for receiving a portion of the exterior portion 66A of the conductive element 64. The exterior portion 66A can include threads 68 and the power source 11 can include complimentary threads 69 in the aperture 67 facilitating attachment of the tank base portion 12 to the power source 11 (FIGS. 2 and 3). The conductive element 64 facilitates transmission of electric power from the power source 11 to heating elements provided in the first heating cup 30 and the second heating cup 32.

The first heating cup 30 and the second heating cup 32 can be releasably attached to the tank base portion 12 and are interchangeable with one another. To facilitate releasable attachment of the first heating cup 30 and the second heating cup 32 to the tank base portion 12, the tank base portion 12 includes threads 78 provided in the interior cavity 48. As such, portions of the first heating cup 30 and the second heating cup 32 can be threadably received in the interior cavity 48 of the tank base portion 12. Furthermore, the enclosure portion 14 is receivable over portions of the first heating cup 30 and the second heating cup 32 to enclose these portions of the first heating cup 30 and the second heating cup 32 therein.

Figure 8:
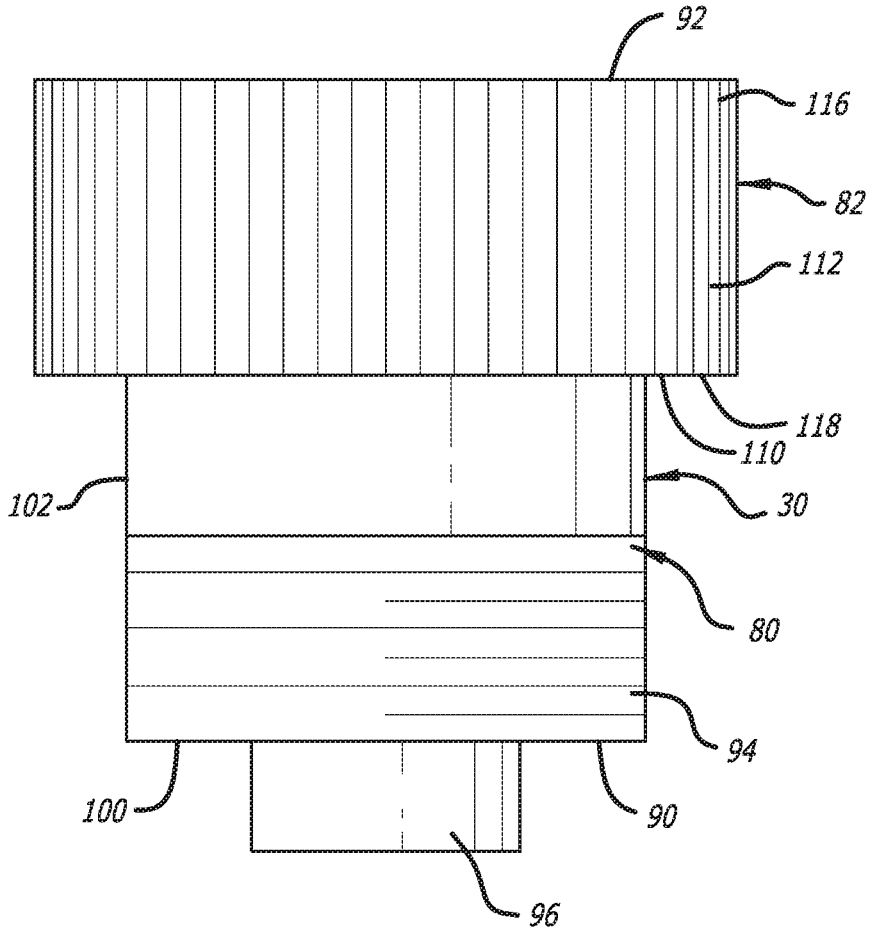
FIG. 8 is an enlarged side elevational view that illustrates a first heating cup of the vaporizer of FIG. 1.
Figure 9:
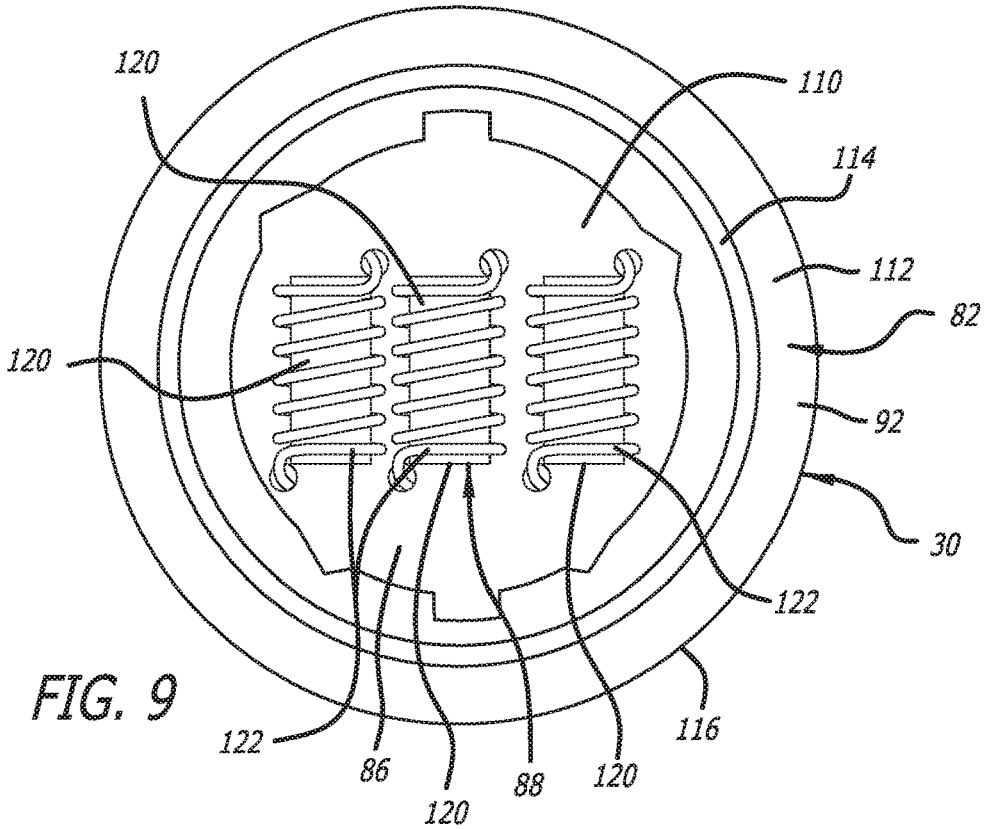
FIG. 9 is an enlarged top plan view that illustrates the first heating cup of the vaporizer of FIG. 1.
Figure 10:
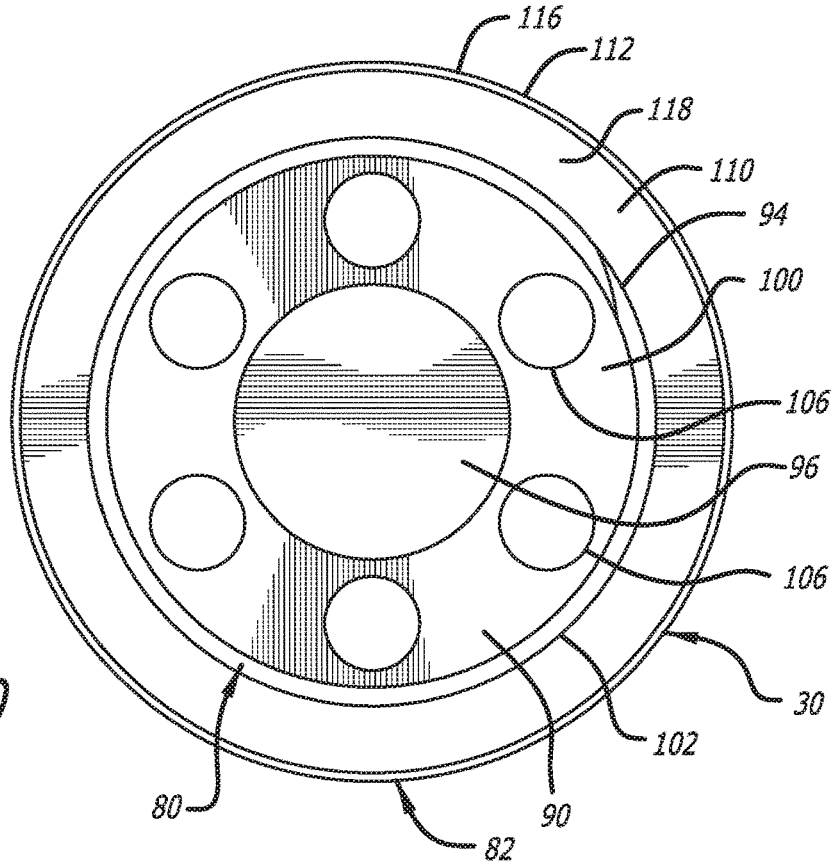
FIG. 10 is an enlarged bottom plan view that illustrates the first heating cup of the vaporizer of FIG. 1.

The first heating cup 30 of FIGS. 8-10 includes a first body portion 80, a second body portion 82, a first interior cavity (not shown) formed in the first body portion 80, a second interior cavity 86 formed in the second body portion 82, a heating source 88, a first end 90, and a second end 92. As discussed below, the first end 90 is closed (but for apertures formed therein), and the second end 92 is open.

As depicted in FIG. 8, the first body portion 80 and the second body portion 82 can have cylindrical exterior surfaces, and the first body portion 80 and the second body portion 82 can be integrally formed with one another. Furthermore, the first body portion 80 extends from the first end 90 to the second body portion 82, and the second body portion 82 extends from the first body portion 80 to the second end 92. The second end 92 provides access to the second interior cavity 86, and the second interior cavity 86 is configured to receive the vaping medium therein.

The first body portion 80 is sized so it can be received in the interior cavity 48, and the second body portion 82 is sized so it can fit within the wall portion 18 of the enclosure portion 14. As depicted in FIGS. 8 and 10, the first body portion 80 includes threads 94 for engaging the threads 78 in the interior cavity 48 to facilitate releasable attachment of the first heating cup 30 to the tank base portion 12.

The first body portion 80, as depicted in FIGS. 8 and 10, includes a conductive element 96 attached thereto for contacting the interior portion 66B of the conductive element 64 when the first heating cup 30 is releasably attached to the tank base portion 12. The first body portion 80 and the second body portion 82 also includes wiring (not shown) extending therethrough for electrically connecting the conductive element 96 to the heating source 88. The conductive element 96 and wiring allow electrical power from the power source 11 via the conductive element 64 to be transmitted to the heating source 88 provided in the second interior cavity 86.

The first body portion 80 includes a lower wall portion 100, an upper wall portion (not shown), and a sidewall portion 102. The upper wall portion is provided on the interior of the first heating cup 30. The first interior cavity is defined by the lower wall portion 100, the upper wall portion, and the sidewall portion 102, and like the exterior surface of the first body portion 80, the interior surface of the sidewall portion 102 can be cylindrical. As depicted in FIG. 10, the first body portion 80 can include various apertures 106 extending through the lower wall portion 100 and communicating with the first interior cavity. The first body portion 80 and the second body portion 82 can also include various passageways (not shown) extending therethrough and affording communication between the first interior cavity and the second interior cavity 86. When the first heating cup 30 is attached to the tank base portion 12, air drawn through the apertures 60 into the interior cavity 48 can be drawn through the apertures 106 and into the first interior cavity, and then can be drawn through the passageways and into the second interior cavity 86. As discussed below, the air drawn into the second interior cavity 86 in this manner is ultimately heated by the heating source 88 after it passes through the first interior cavity and the passageways.

As depicted in FIGS. 8 and 9, the second body portion 82 includes a lower wall portion 110, a first sidewall portion 112, and a second sidewall 114. The lower wall portion 110 can be collocated with a portion the upper wall portion of the first body portion 80, the second sidewall portion 114 is disposed within the first sidewall portion 112, the second interior cavity 86 is defined by the lower wall portion 110 and the second sidewall portion 114, and like the exterior surface of the second body portion 82, the interior surface of the second sidewall portion 114 can be cylindrical. The second body portion 82 can include various ridges 116 formed on the exterior surface of the first sidewall portion 112. The ridges 116 can serve as a handhold allowing a user to manipulate the first heating cup 30 into position with respect to the tank base portion 12. The second body portion 82 can also include a shoulder portion 118 formed on the lower wall portion 110 for contacting the tank base portion 12 to limit insertion of the first heating cup 30 therein. Furthermore, the first sidewall portion 112 can be integrally formed with the first body portion 80, and the lower wall portion 110 and the second sidewall portion 114 can be made of a material such as ceramic.

As discussed above, the wiring in the first heating cup 30 extends into the second interior cavity 86 from the conductive element 96, and the passageways extend to the second interior cavity 86 from the first interior cavity. As such, electrical power is transmitted into the second interior cavity 86, and air can be drawn into the second interior cavity 86.

The heating source 88, as depicted in FIG. 9, includes heating elements 120 and wire coils 122. The heating source 88 preferably includes three (3) of the heating elements 120 and the wire coils 122. One of the wire coils 122 is wound around one of the heating elements 120, and the wire coils 122 are electrically connected to the wiring extending from the conductive element 96. As such, electrical power can be transmitted to the heating elements 120 from the power source 11 via the wire coils 122. In doing so, the heating elements 120 can be energized by such electrical power to generate heat. Preferably, the heating elements 120 can be made of quartz rods.

During use of the vaporizer 10 incorporating the first heating cup 30, the vaping medium can be inserted into the second interior cavity 86. The vaping medium can be placed adjacent, around, and/or on top of the heating elements 120. When energized, the heating elements 120 serve to vaporize the vaping medium. The vaporizing and inhaling of the vaporized vaping medium is aided by air flow through at least the first heating cup 30. Air is drawn through the apertures 60 into the interior cavity 48, then drawn through the apertures 106 and into the first interior cavity of the first body portion 80, and then can be drawn through the passageways and into the second interior cavity 86. As it passes through the second interior cavity 86, the air is heated by the heating elements 120. Thus, when the user inhales through the inhaler portion 20, air drawn through the vaporizer 10 aids vaporization of the vaping medium, and the vaporized vaping medium along with the air drawn through the vaporizer 10 is drawn into the user's oral cavity, upper respiratory track, and lower respiratory track.

As depicted in FIGS. 11-14, the second heating cup 32 includes a cup base portion 130 and a cup portion 132. As discussed below, the cup portion 132 is partially received within the cup base portion 130.

Figure 11:
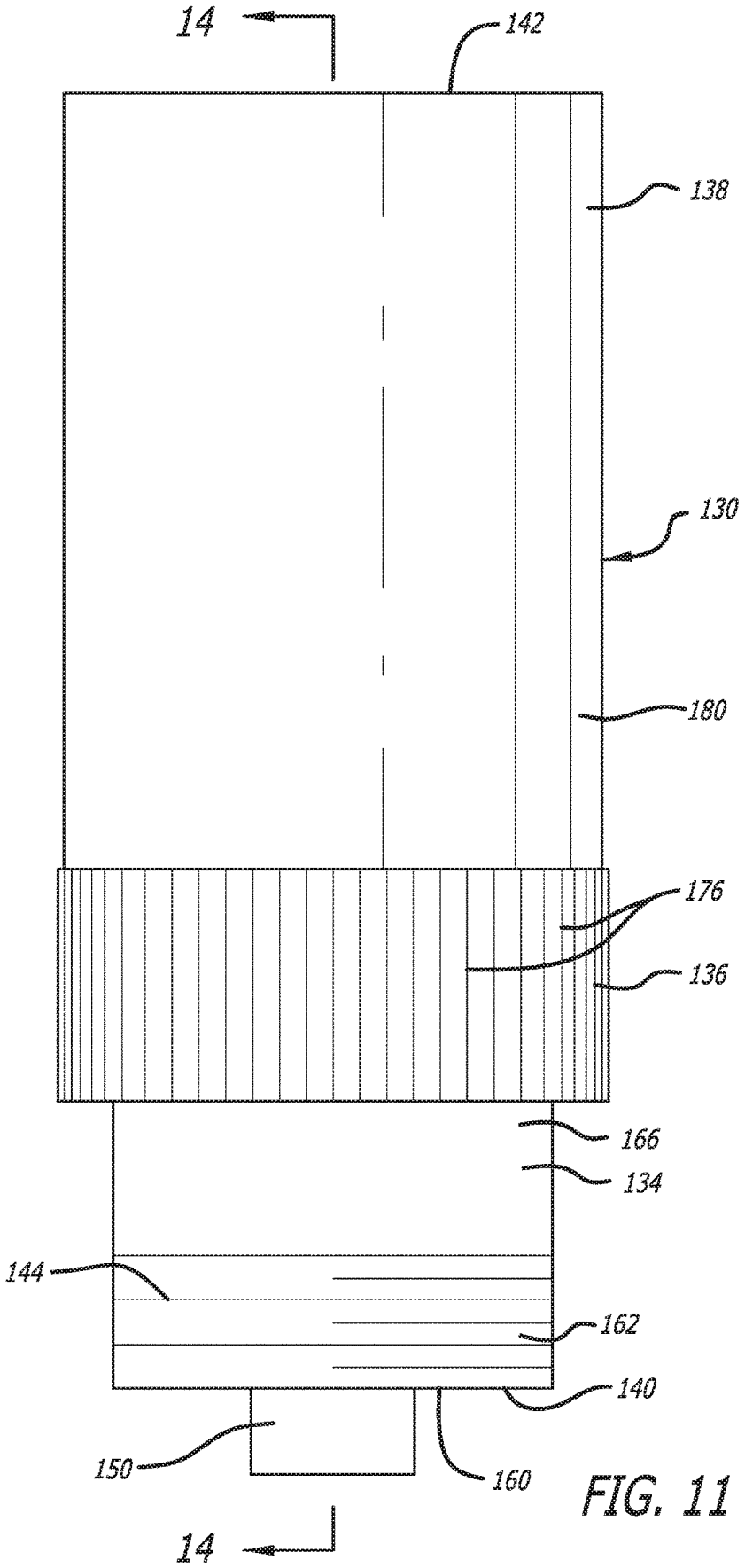
FIG. 11 is an enlarged side elevational view that illustrates a second heating cup of the vaporizer of FIG. 1.
Figure 12:
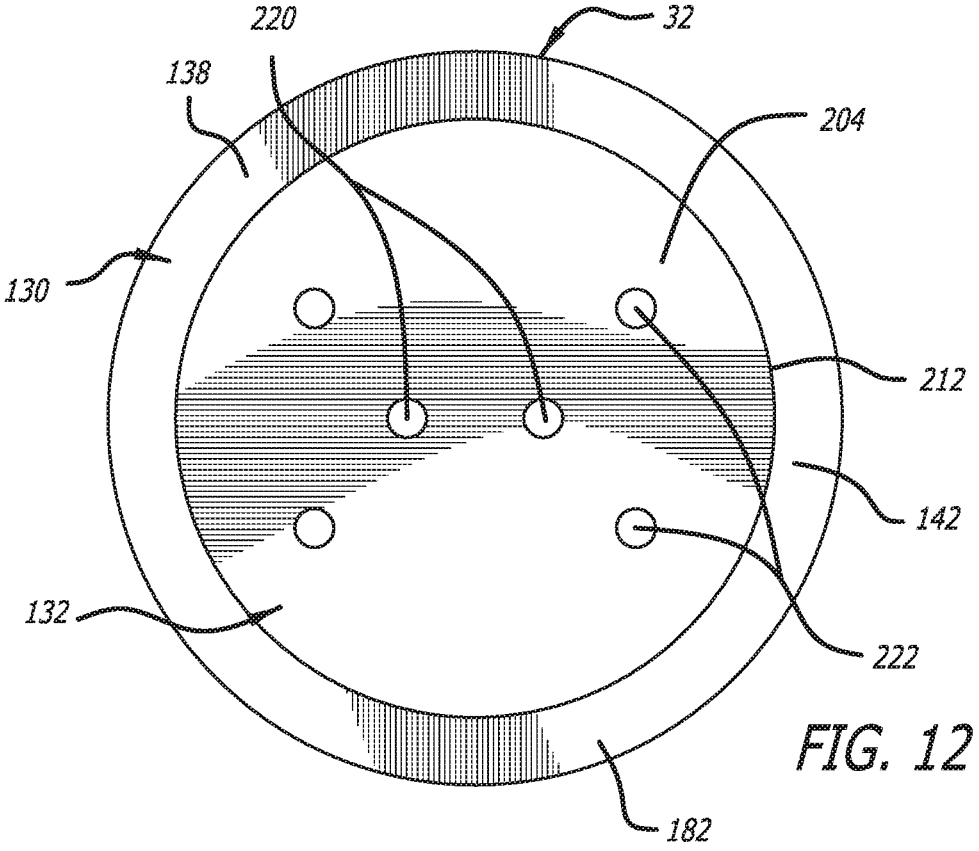
FIG. 12 is an enlarged top plan view that illustrates the second heating cup of the vaporizer of FIG. 1.
Figure 13:
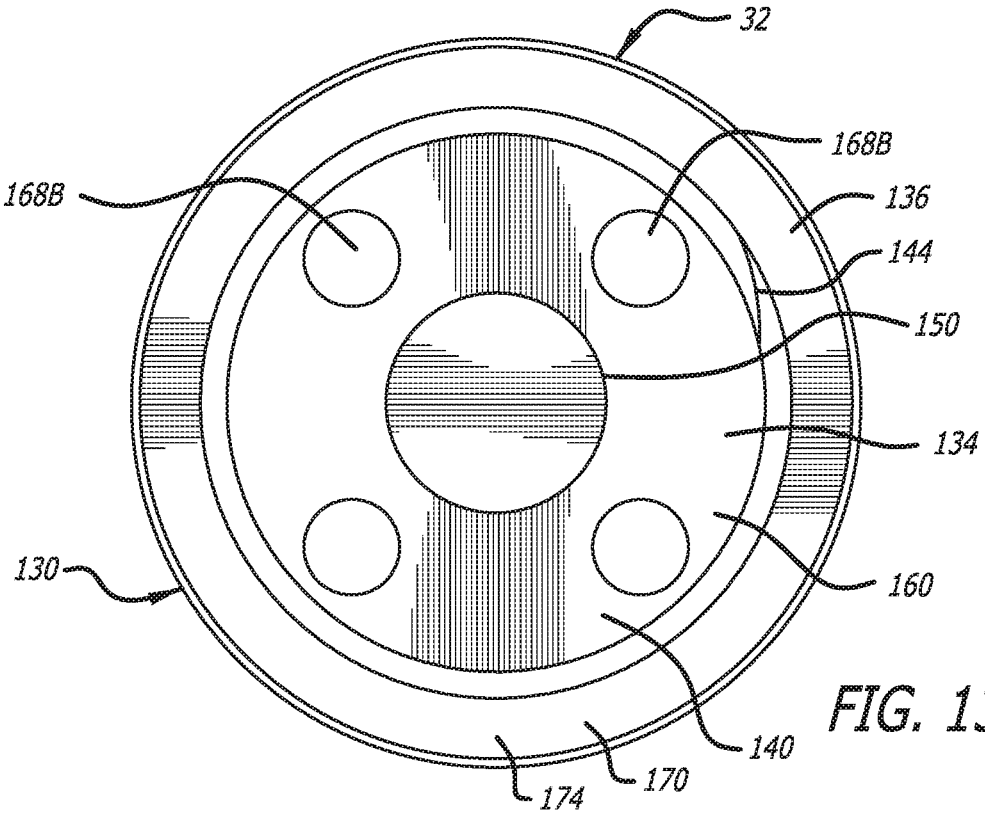
FIG. 13 is an enlarged bottom plan view that illustrates the second heating cup of the vaporizer of FIG. 1.
Figure 14:
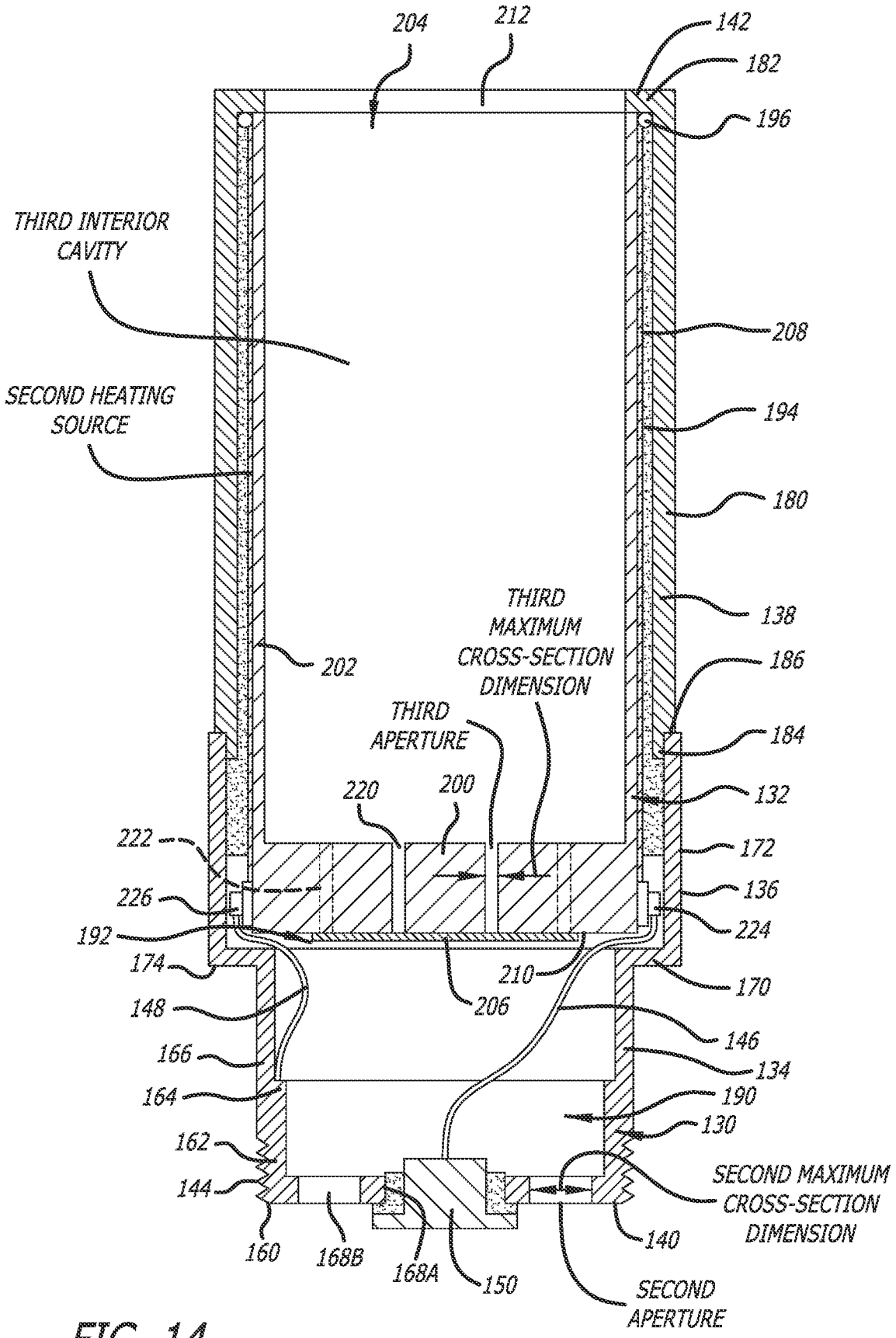
FIG. 14 is a cross-sectional view of the second heating cup taken along Line 14-14 of FIG. 11.

The cup base portion 130, as depicted in FIGS. 11, 13 and 14, includes a first body portion 134, a second body portion 136, a third body portion 138, a first end 140, and a second end 142. As discussed below, the first end 140 is closed (but for apertures formed therein), and the second end 142 is open. The first body portion 134, the second body portion 136, and the third body portion 138 can have cylindrical exterior surfaces. The first body portion 134 and the second body portion 136 can be integrally formed with one another, and a press-fit connection can be formed between the second body portion 136 and the third body portion 138. The first body portion 134 extends from the first end 140 toward the second end 142, the second body portion 136 extends from the first body portion 134 to an overlap with the third body portion 138, and the third body portion 138 extends from the overlap with the third body portion 138 to the second end 142.

Portions of the first body portion 134 are sized so that they can be received in the interior cavity 48, and other portions of the first body portion 134, the second body portion 136, and the third body portion 138 are sized so that they can fit within the wall portion 18 of the enclosure portion 14. As depicted in FIGS. 11, 13, and 14, the first body portion 134 includes threads 144 for engaging the threads 78 in the interior cavity 48 to facilitate releasable attachment of the second heating cup 32 to the tank base portion 12.

Furthermore, as depicted in FIG. 14, the cup portion 132 includes a positive wire 146 and a negative wire 148, where the positive wire 146 is electrically connected to a conductive element 150 attached to the first body portion 134, and the negative wire 148 is electrically connected to the first body portion 134. The conductive element 150 is for contacting the interior portion 66B of the conductive element 64 when the second heating cup 32 is releasably attached to the tank base portion 12. The positive wire 146, the negative wire 148, and the conductive element 150 allow electrical power from the power source 11 via the conductive element 64 to be transmitted to the cup portion 132.

The first body portion 134, as depicted in FIGS. 11 and 14, includes a bottom wall portion 160, a first sidewall portion 162, an intermediate wall portion 164, and a second sidewall portion 166. Like the exterior surfaces of the first body portion 134, the interior surfaces of the first sidewall portion 162 and the second sidewall portion 166 can be cylindrical. The bottom wall portion 160 can be collocated with the first end 140, and the bottom wall portion 160 can include an aperture 168A extending therethrough for receiving the conductive element 150 therein, and apertures 168B extending therethrough for allowing the passage of air. The first sidewall portion 162 is sized to be received in the interior cavity 48, and the threads 144 are formed on the exterior surface of the first sidewall portion 162.

The second body portion 136, as depicted in FIGS. 11 and 14, includes a bottom wall portion 170, a sidewall portion 172, a shoulder portion 174 formed on the exterior surface of the bottom wall portion 170, and ridges 176 formed on the exterior surface of the sidewall portion 172. Like the exterior surfaces of the second body portion 136, the interior surface of the sidewall portion 172 can be cylindrical. The shoulder portion 174 contacts the tank base portion 12 to limit insertion of the second heating cup 32 therein. Furthermore, the ridges 176 can serve as a handhold allowing a user to manipulate the second heating cup 32 into position with respect to the tank base portion 12.

The third body portion 138, as depicted in FIGS. 11 and 14, includes a sidewall portion 180, a top wall portion 182, and a lip portion 184 and a shoulder portion 186 formed on the exterior surface of the sidewall portion 180. Like the exterior surfaces of the third body portion 138, the interior surfaces of the sidewall portion 180 can be cylindrical. The top wall potion 182 can be collocated with the second end 142, the lip portion 184 is received within the second body portion 136, and the shoulder portion 186 contacts the second body portion 136. The press-fit connection between the second body portion 136 and the third body portion 138 can be provided by the interaction of the lip portion 184 and the shoulder portion 186 with the second body portion 136.

As depicted in FIG. 14, the first body portion 134 defines an interior cavity portion 190, and the second body portion 136 and the third body portion 138 define an interior cavity portion 192. The interior cavity portion 190 extends from the bottom wall portion 160 at the first end 140 to adjacent the bottom wall portion 170, and the interior cavity portion 192 extends from the bottom wall portion 170 to the second end 142. As depicted in FIG. 14, the cup portion 132 is positioned in the interior cavity portion 192, and the interior cavity portion 190 and a portion of the interior cavity portion 192 below the cup portion 132 forms a second stage air heating chamber for heating air drawn through the vaporizer 10.

Insulation 194, as depicted in FIG. 14, is provided between the sidewall portion 180 and the cup portion 132 in the interior cavity portion 192. Furthermore, an O-ring 196 is also provided between the sidewall portion 180 and the cup portion 132 adjacent the top wall portion 182. The insulation 194 serves to thermally isolate the cup portion 132 from the second body portion 136 and the third body portion 138, and the O-ring 196 is used in seating the cup portion 132 with respect to the cup base portion 130 adjacent the second end 142.

Figure 15:
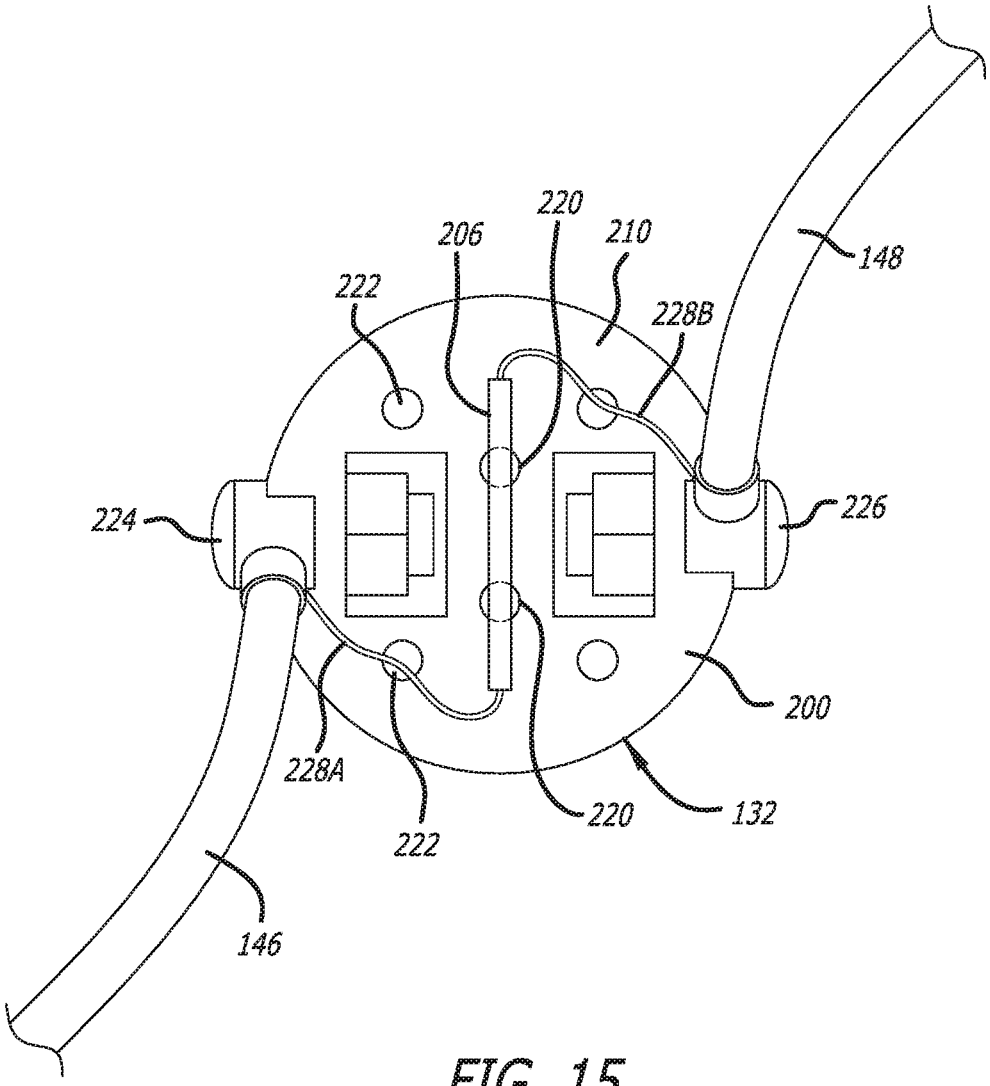
FIG. 15 is an enlarged bottom plan view that illustrates a cup portion of the second heating cup of the vaporizer of FIG. 1.
Figure 16:
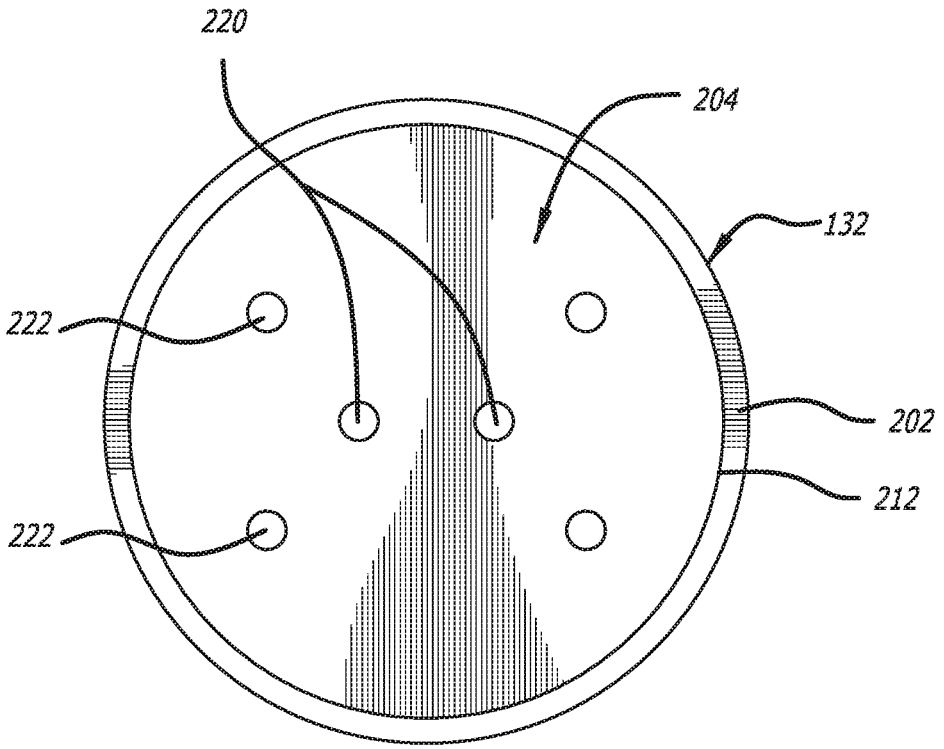
FIG. 16 is an enlarged top plan view that illustrates the cup portion of the second heating cup of the vaporizer of FIG. 1.

The cup portion 132, as depicted in FIGS. 14-16, includes a lower wall portion 200, a sidewall portion 202, an interior cavity 204, a first heating source 206, a second heating source 208, a first end 210, and a second end 212. As discussed below, the first end 210 is closed (but for apertures formed therein), and the second end 212 is open. The cup portion 132 can be made of a material such as ceramic. Furthermore, the sidewall portion 202, as depicted in FIGS. 14 and 16, can have cylindrical exterior and interior surfaces. Also, the lower wall portion 200 extends from the closed first end 210 to the sidewall portion 202, and the sidewall portion 202 extends from the lower wall portion 200 to the open second end 212. The open second end 212 provides access to the interior cavity 204, and the interior cavity 204 is configured to receive the vaping medium therein.

The first heating source 206 is provided as part of the lower wall portion 200, and the second heating source 208 is provided as part of the sidewall portion 202. The first heating source 206 can be made of one or more heating elements positioned on and/or in the lower wall portion 200), and the second heating source 208 can be made of various heating elements positioned on and/or in the sidewall portion 202. The first heating source 206 and the second heating source 208 can be metal ceramic heaters including one or more heating elements. To illustrate, the first heating source 206, as depicted in FIG. 14, is a single metal ceramic heater extending across a portion of the lower wall portion 200. Furthermore, the first heating source 206 and the second heating source 208 can be a heatable layer or film provided on portions of the lower wall portion 200 and the sidewall portion 202. To illustrate, the second heating source 208, as depicted in FIG. 14, is a heatable layer or film provided on the sidewall portion 202. The heatable layer or film can be provided adjacent, along, and/or over all or portions of the lower wall portion 200 and the sidewall portion 202. Also, the first heating source 206 and the second heating source 208 may be two separate heating sources in one preferred embodiment of the invention or may be a single heating source with portions of the heating source located on and/or in the lower wall portion 200 and other portions located on and/or in the sidewall portion 202. In another preferred embodiment, the first heating source 206 is located on the bottom or lowermost portion of the lower wall portion 200 so as to better preheat the air passing through the second stage air heating chamber before the air passing into the interior cavity 204.

As depicted in FIGS. 14-16, the lower wall portion 200 also includes apertures 220 and apertures 222. The apertures 220 and 222 are formed through the lower wall portion 200, and pass through and/or pass adjacent to the first heating source 206. For example, the apertures 220 pass through the first heating source 206, and the apertures 222 pass adjacent to the first heating source 206. As such, air passing through the apertures 220 and/or the apertures 222 can be heated by the first heating source 206 prior to entering the interior cavity 204.

Terminals 224 and 226, as depicted in FIGS. 14 and 15, are provided on the lower wall portion 200. The terminals 224 and 226 are electrically connected to the first heating source 206 and the second heating source 208. The positive wire 146 can be electrically connected to the terminal 224, and the negative wire 148 can be electrically connected to the terminal 226. As discussed above, the positive wire 146 and the negative wire 148 are ultimately electrically connected to the power source 11. The positive wire 146 and the terminal 224 are connected to the first heating source 206 via a wire lead 228A, and the negative wire 148 and the terminal 226 are connected to the first heating source 206 via a wire lead 228B. Furthermore, the positive wire 146 and the terminal 224 are operatively connected to the second heating source 208 via a first electrical connection, and the negative wire 148 and the terminal 226 are operatively connected to the second heating source 208 via a second electrical connection. As such, electrical power can be transmitted to the first heating source 206 and the second heating source 208 via the terminals 224 and 226, the positive wire 146, and the negative wire 148. In doing so, the heating elements of the first heating source 206 and the second heating source 208 can be energized by the such electrical power to generate heat.

During use of the vaporizer 10 incorporating the second heating cup 32, the vaping medium can be inserted into the interior cavity 204. When energized, the first heating source 206 and the second heating source 208 heat the cup portion 132 and serve to vaporize the vaping medium via conduction. The interior cavity 204 is a third or final stage air heating chamber. The vaporizing and inhaling of the vaporized vaping medium in the interior cavity 204 is further aided by air flow through the tank base portion 12 and the second heating cup 32. In addition to heating the interior cavity 204, the first heating source 206 is also used to heat the tank base portion 12, and heat the first body portion 134 and the second body portion 136 of the cup base portion 130. As such, the first heating source 206 provides heat to both the first stage air heating chamber defined by portions of the interior cavity 48 in the tank base portion 12, and the second stage air heating chamber defined by portions of the interior cavity portion 190 and the interior cavity portion 192 in the first body portion 134 and the second body portion 136. Air is drawn through the apertures 60 into the interior cavity 48 (and the first stage air heating chamber), and then drawn through the apertures 168B and into portions of the interior cavity portion 190 and the interior cavity portion 192 (and the second stage air heating chamber). The air drawn through the first stage air heating chamber and the second stage air heating chamber is heated via convection. The heated air then passes through the apertures 220 and 222 in which the heated air is heated further by convection. As such, the air entering the interior cavity 204 is preheated by the first stage air heating chamber, the second stage air heating chamber, and the first heating source 206, and the preheated air serves in aiding the vaporization of the vaping medium. Thus, when the user inhales through the inhaler 20, air drawn through the vaporizer 10 aid vaporization of the vaping medium, and the vaporized vaping medium along with the air drawn through the vaporizer 10 is drawn into the user's oral cavity, upper respiratory track, and lower respiratory track.

As discussed above, the enclosure portion 14 includes the wall portion 18, the inhaler portion 20 and the containment mechanism 22. As depicted in FIGS. 1-3, inhaler portion 20 extends through a top surface 230 of the wall portion 18, and the inhaler portion 20 includes a first end 232, a second end 234, and an aperture 236 extending through the top surface 230. The aperture 236 fluidly communicates with the interior of the wall portion 18. As such, a user can inhale air through the vaporizer 10 using the inhaler portion 20.

Additionally, the containment mechanism 22, as depicted in FIGS. 1-3, is attached to the inhaler portion 20 at or adjacent the first end 232 thereof. The containment mechanism 22 includes a spring portion 240 attached at one end to the inhaler portion 20, and a tamp portion 242 attached to the other end of the spring portion 240. The tamp portion 242 includes apertures (not shown) therethrough. When the vaping medium is received in the interior cavity 204, and the enclosure portion 14 is attached to the tank base portion 12, the spring portion 240 and the tamp portion 242 are used to aid containment of the vaping medium in the interior cavity, while simultaneously allowing the vaporized vaping medium and the air drawn through the vaporizer 10 to exit the interior cavity 204 via at least the apertures.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

We claim:

1. A vaporizer for vaporizing a vaping medium for use with a vaping device, the vaporizer comprising:

a first end, an opposite second end, and a mid-longitudinal axis extending through the first and second ends;

a tank base portion being provided at or adjacent the first end, the tank base portion including a bottom wall portion, at least one sidewall portion extending upwardly from the bottom wall portion, an interior cavity defined at least in part by the bottom wall portion of the tank base portion and the at least one sidewall portion of the tank base portion, and at least one first aperture through the at least one sidewall portion of the tank base portion communicating with an exterior portion of the vaporizer and provided adjacent the first end, the at least one first aperture through the at least one sidewall portion of the tank base portion fluidly communicating with the interior cavity of the tank base portion and outside of the vaporizer;

an enclosure portion supported by the tank base portion and extending from the tank base portion toward the second end, the enclosure portion including a wall portion, an interior defined at least in part by the wall portion, and an inhaler portion at or adjacent the second end; and a heating cup for vaporizing the vaping medium, the heating cup including a first heating cup end, a second heating cup end, and a first plane dividing the heating cup into a first lateral portion and a second lateral portion, and extending along the mid-longitudinal axis and through the first heating cup end and the second heating cup end, a first portion of the heating cup being received in a portion of the tank base portion, and a second portion being received in the interior of the wall portion of the enclosure portion, the heating cup including a cup base portion and a cup portion, the cup base portion including a bottom wall portion, at least one sidewall portion extending upwardly from the bottom wall portion of the cup base portion, a first interior cavity defined at least in part by the bottom wall portion of the cup base portion and the at least one sidewall portion of the cup base portion, and at least one second aperture through the bottom wall portion of the cup base portion, the cup portion including a bottom wall portion, at least one sidewall portion extending upwardly from the bottom wall portion of the cup portion, a second interior cavity defined at least in part by the bottom wall portion of the cup portion and the at least one sidewall portion of the cup portion, a first heating source provided in and/or adjacent the bottom wall portion of the cup portion, a second heating source provided in the at least one side wall portion of the cup portion, and at least one third aperture through the bottom wall portion of the cup portion passing adjacent the mid-longitudinal axis, through portions of the first plane, and adjacent to the first heating source, the cup portion being configured to receive the vaping medium in the second interior cavity thereof;

wherein the first heating source and the second heating source are configured to heat portions of the heating cup to form an air heating chamber defined in part by portions of the first interior cavity, configured to directly heat air passing through the at least one third aperture through the bottom wall portion of the cup portion, and configured to heat portions of the cup portion to form an air heating chamber defined in part by portions of the second interior cavity;

wherein the interior cavity of the tank base portion is closer to the first end than the first interior cavity of the cup base portion and the second interior cavity of the cup portion, and the first interior cavity of the cup base portion is closer to the first end than the second interior cavity of the cup portion;

wherein the at least one first aperture has a first maximum cross-sectional dimension, the at least one second aperture has a second maximum cross-sectional dimension, and the at least one third aperture has a third maximum cross-sectional dimension, the first maximum cross-sectional dimension being greater than the second maximum cross-sectional dimension and the third maximum cross-sectional dimension, and the second maximum cross-sectional dimension being greater than the third maximum cross-sectional dimension;

wherein, during use of the vaporizer, air is initially drawn from the outside of the vaporizer at the first end thereof through the at least one first aperture through the at least one sidewall of the tank base portion and into the interior cavity of the tank base portion, the air is drawn from the tank base portion through the at least one second aperture through the bottom wall portion of the cup base portion and into the air heating chamber defined in part by the portions of the first interior cavity, and the air is drawn from the air heating chamber defined in part by the portions of the first interior cavity through the at least one third aperture through the bottom wall portion of the cup portion and into the air heating chamber defined in part by the portions of the second interior cavity; and wherein the air entering the air heating chamber defined in part by the portions of the second interior cavity passes through progressively smaller and smaller orifices via passage through the at least first one first aperture, then the at least one second aperture, and then the at least one third aperture, the air entering the air heating chamber defined in part by the portions of the second interior cavity being used to vaporize the vaping medium, and vaporized vaping medium exits the vaporizer through the inhaler portion at the second end thereof.

2. The vaporizer of claim 1, wherein the size of the at least one aperture through the at least one sidewall portion of the tank base portion can be adjusted to correspondingly adjust a volume of the air admitted into the vaporizer.

3. The vaporizer of claim 1, wherein the interior cavity of the tank base portion includes first threads provided therein, and the first portion of the heating cup includes second threads provided thereon, the first threads and the second threads being capable of cooperatively engaging one another to facilitate attachment of the heating cup to the tank base portion.

4. The vaporizer of claim 1, wherein the inhaler portion is attached to the wall portion of the enclosure portion.

5. The vaporizer of claim 4, wherein the inhaler portion includes an opening therethrough allowing fluid communication between the interior of the wall portion of the enclosure portion and the outside of the vaporizer.

6. The vaporizer of claim 1, wherein the vaping medium is vaporized via convection by applying the air heated in the air heating chamber defined in part by the portions of the first interior cavity and the air heating chamber defined in part by the portions of the second interior cavity thereto, and via conduction applied directly to the vaping medium received in the second interior cavity.

7. The vaporizer of claim 6, wherein the second heating source is used to vaporize the vaping medium via conduction applied directly to the vaping medium received in the second interior cavity.

8. The vaporizer of claim 1, wherein, when the air is drawn through portions of the vaporizer, the air travels in part along the mid-longitudinal axis of the vaporizer through the air heating chamber defined in part by the portions of the interior cavity of the tank base portion, through the air heating chamber defined in part by portions of the first interior cavity, and through the air heating chamber defined in part by portions of the second interior cavity.

9. A method of preheating air drawn through a vaporizer used with a vaping device, the method comprising;

providing a vaporizer having a first end, an opposite second end, a mid-longitudinal axis extending through the first and second ends, at least a tank base portion being provided at and adjacent the first end, a heating cup extending from the tank base portion toward the second end, and an inhaler portion provided at or adjacent the second end, the tank base portion including at least one sidewall portion, a first interior cavity defined at least in part by the at least one sidewall portion of the tank base portion, and at least one first aperture through the at least one sidewall portion of the tank base portion communicating with an exterior portion of the vaporizer and provided adjacent the first end, the heating cup including a first heating cup end, a second heating cup end, and a first plane dividing the heating cup into a first lateral portion and a second lateral portion, and extending along the mid-longitudinal axis and through the first heating cup end and the second heating cup end, the heating cup including a cup base portion and a cup portion, the cup base portion including a bottom wall portion, at least one side wall portion, a second interior cavity defined at least in part by the bottom wall portion of the cup base portion and the at least one sidewall portion of the cup base portion, and at least one second aperture through the bottom wall portion of the cup base portion, the cup portion including a bottom wall portion, at least one side wall portion, a vaping medium receiving cavity defined at least in part by the bottom wall portion of the cup portion and the at least one side wall portion of the cup portion, a first heating source provided in and/or adjacent the bottom wall portion of the cup portion, a second heating source provided in the at least one side wall portion of the cup portion, and at least one third aperture through the bottom wall portion of the cup portion passing adjacent the mid-longitudinal axis, through portions of the first plane, and adjacent to the first heating source;

heating portions of the cup base portion with the first heating source to form an air heating chamber defined in part by portions of the second interior cavity;

heating portions of the cup portion with the first heating source and the second heating source to form an air heating chamber defined in part by portions of the vaping medium receiving cavity;

initially drawing air from outside of the vaporizer at the first end thereof through the at least one first aperture through the at least one sidewall portion of the tank base portion and into the first interior cavity defined at least in part by the at least one sidewall portion of the tank base portion;

passing the air from the first interior cavity defined at least in part by the at least one sidewall portion of the tank base portion through the at least one second aperture formed in the bottom wall portion of the cup base portion and into the air heating chamber defined in part by portions of the second interior cavity;

directly heating and passing the air from the air heating chamber defined in part by the portions of the second interior cavity through the at least one third aperture formed in the bottom wall portion of the cup portion prior to entry thereof into the air heating chamber defined in part by the portions of the vaping medium receiving cavity;

vaporizing a vaping medium provided in the vaping medium receiving cavity by simultaneously using convection via the heated air and using conduction via contact with the heated portions of the cup portion heated by the first heating source and the second heating source; and passing the vaporized vaping medium from the vapor medium receiving cavity out of the vaporizer through the inhaler portion at the second end thereof;

wherein the first interior cavity of the tank base portion is closer to the first end than the second interior cavity and the vaping medium receiving cavity, and the second interior cavity is closer to the first end than the vaping medium receiving cavity;

wherein the at least one first aperture has a first maximum cross-sectional dimension, the at least one second aperture has a second maximum cross-sectional dimension, and the at least one third aperture has a third maximum cross-sectional dimension, the first maximum cross-sectional dimension being greater than the second maximum cross-sectional dimension and the third maximum cross-sectional dimension, the second maximum cross-sectional dimension being greater than the third maximum cross-sectional dimension; and wherein the air entering the air heating chamber defined in part by the portions of the vaping medium receiving cavity passes through progressively smaller and smaller orifices via passage through the at least first one first aperture, then the at least one second aperture, and then the at least one third aperture.

10. The method of claim 9, further comprising heating portions of the tank base portion with the first heating source to form an air heating chamber defined in part by portions of the first interior cavity of the tank base portion.

11. The method of claim 10, further comprising preheating air passing through the air heating chamber defined in part by the portions of the first interior cavity of the tank base portion, and passing the preheated air into the air heating chamber defined in part by the portions of the second interior cavity.

12. The method of claim 11, wherein, when the air is passes through portions of the vaporizer, the air travels in part along the mid-longitudinal axis of the vaporizer through the air heating chamber defined in part by the portions of the first interior cavity of the tank base portion, and through the air heating chamber defined in part by portions of the second interior cavity.

13. The method of claim 9, further comprising vaporizing the vaping medium using conduction via contact with the at least one sidewall portion of the cup portion heated by the second heating source.

14. A vaporizer for vaporizing a vaping medium for use with a vaping device, the vaporizer comprising:

a first end, an opposite second end, and a mid-longitudinal axis extending through the first and second ends;

a tank base portion being provided at or adjacent the first end, the tank base portion including at least one sidewall portion, a first interior cavity defined at least in part by the at least one sidewall portion of the tank base portion, and at least one first aperture through the at least one sidewall portion of the tank base portion communicating with an exterior portion of the vaporizer and provided adjacent the first end, the at least one first aperture through the at least one side wall portion of the tank base portion fluidly communicating with the first interior cavity and outside of the vaporizer;

an enclosure portion supported by the base portion and extending from the tank base portion toward the second end, the enclosure portion including a wall portion, an inhaler portion, an interior defined at least in part by the wall portion, the inhaler portion being attached to the wall portion and provided at or adjacent the second end, the inhaler portion including an opening therethrough allowing fluid communication between the interior of the wall portion and the outside of the vaporizer; and a heating cup for vaporizing the vaping medium, the heating cup including a first heating cup end, a second heating cup end, and a first plane dividing the heating cup into a first lateral portion and a second lateral portion, and extending along the mid-longitudinal axis and through the first heating cup end and the second heating cup end, a first portion of the heating cup being received in the first interior cavity of the tank base portion, and a second portion of the heating cup being received in the interior of the wall portion of the enclosure portion, the heating cup including a cup base portion and a cup portion, the cup base portion including a bottom wall portion, at least one sidewall portion extending upwardly from the bottom wall portion of the cup base portion, a second interior cavity defined at least in part by the bottom wall portion of the cup base portion and the at least one sidewall portion of the cup base portion, and at least one second aperture through the bottom wall portion of the cup base portion, the cup portion including a bottom wall portion, at least one sidewall portion extending upwardly from the bottom wall portion of the cup portion, a third interior cavity defined at least in part by the bottom wall portion of the cup portion and the at least one sidewall portion of the cup portion, a first heating source provided in and/or adjacent the bottom wall portion of the cup portion, a second heating source provided in the at least one side wall portion of the cup portion, and at least one third aperture through the bottom wall portion of the cup portion passing adjacent the mid-longitudinal axis, through portions of the first plane, and adjacent to the first heating source, the cup portion being configured to receive the vaping medium therein;

wherein the first heating source and the second heating source are configured to heat portions of the heating cup and the tank base portion including an air heating chamber defined in part by portions of the first interior cavity of the tank base portion, an air heating chamber defined in part by portions of the second interior cavity of the cup base portion, and an air heating chamber defined in part by portions of the third interior cavity of the cup portion, and configured to directly heat air passing through the at least one third aperture through the bottom wall portion of the cup portion;

wherein the first interior cavity of the tank base portion is closer to the first end than the second interior cavity of the cup base portion and the third interior cavity of the cup portion, and the second interior cavity of the cup base portion is closer to the first end than the third interior cavity of the cup portion;

wherein the at least one first aperture has a first maximum cross-sectional dimension, the at least one second aperture has a second maximum cross-sectional dimension, and the at least one third aperture has a third maximum cross-sectional dimension, the first maximum cross-sectional dimension being greater than the second maximum cross-sectional dimension and the third maximum cross-sectional dimension, and the second maximum cross-sectional dimension being greater than the third maximum cross-sectional dimension;

wherein, during use of the vaporizer, air is initially drawn from the outside of the vaporizer at the first end thereof through the at least one first aperture through the at least one sidewall of the tank base portion into the air heating chamber defined in part by the portions of the first interior cavity, the air is drawn from the air heating chamber defined in part by the portions of the first interior cavity of the tank base portion through the at least one second aperture through the bottom wall portion of the cup base portion into the air heating chamber defined in part by the portions of the second interior cavity of the cup base portion, and the air is drawn from the air heating chamber defined in part by the portions of the second interior cavity of the cup base portion through the at least one third aperture through the bottom wall portion of the cup portion and into the air heating chamber defined in part by the portions of the third interior cavity of the cup portion;

wherein the air entering the air heating chamber defined in part by the portions of the third interior cavity of the cup portion passes through progressively smaller and smaller orifices via passage through the at least first one first aperture, then the at least one second aperture, and then the at least one third aperture, the air entering the air heating chamber defined in part by the portions of the third interior cavity of the cup portion being used to vaporize the vaping medium, and vaporized vaping medium exits the vaporizer through the inhaler portion at the second end thereof.

15. The vaporizer of claim 14, wherein the first interior cavity includes first threads provided therein, and the first portion of the heating cup includes second threads provided therein, the first threads and the second threads being capable of cooperatively engaging one another to facilitate attachment of the heating cup to the tank base portion.

16. The vaporizer of claim 14, wherein, when the air is drawn through portions of the vaporizer, the air travels in part along the mid-longitudinal axis of the vaporizer through the air heating chamber defined in part by the portions of the first interior cavity of the tank base portion, through the air heating chamber defined in part by portions of the second interior cavity of the cup base portion, and through the air heating chamber defined in part by portions of the third interior cavity of the cup portion.

* * * * *